US005378379A

United States Patent [19]

Bershas

[11] Patent Number: 5,378,379

[45] Date of Patent: Jan. 3, 1995

[54] AQUEOUS LUBRICANT AND SURFACE CONDITIONER, WITH IMPROVED STORAGE STABILITY AND HEAT RESISTANCE, FOR METAL SURFACES

[75] Inventor: James P. Bershas, West Bloomfield, Mich.

[73] Assignee: Henkel Corporation, Plymouth Meeting, Pa.

[21] Appl. No.: 90,724

[22] Filed: Jul. 13, 1993

[51] Int. Cl.[6] ..... C10M 173/02; C10M 137/08

[52] U.S. Cl. ..... 252/49.3; 252/25; 252/26; 252/32.5; 252/49.9; 252/54; 252/52 A; 72/42

[58] Field of Search ..... 252/49.9, 49.3

[56] References Cited

U.S. PATENT DOCUMENTS

| | | | |
|---|---|---|---|
| 4,332,689 | 6/1982 | Tanizaki et al. | 252/49.3 |
| 4,452,712 | 6/1984 | Laemmle | 252/49.3 |
| 4,490,536 | 12/1984 | Corti et al. | 584/112 |
| 4,859,351 | 8/1989 | Awad | 252/32.5 |
| 4,921,552 | 5/1990 | Sander et al. | 14.8/247 |
| 4,944,889 | 7/1990 | Awad | 252/32.5 |
| 5,030,323 | 7/1991 | Awad | 156/665 |
| 5,061,389 | 10/1991 | Reichgott | 252/49.3 |
| 5,064,500 | 9/1990 | Awad | 156/665 |
| 5,139,586 | 8/1992 | Das | 148/246 |

OTHER PUBLICATIONS

"Phosphoteric ® T-C6"; Mona Industries, Inc. Technical Bulletin, Mar. 1989.

*Primary Examiner*—Ellen M. McAvoy

*Attorney, Agent, or Firm*—Ernest G. Szoke; Wayne C. Jaeschke; Norvell E. Wisdom, Jr.

[57] ABSTRACT

A combination of phosphonoinidazoline at surfactant, soluble polyvalent metal ions, and a metal etching component, which is tolerant of aluminum cations and aluminate anions, when used as the Stage 4 rinse for aluminum cans provides good can mobility and good resistance to loss of mobility during heating of the treated cans to a greater extent than is normal during high speed processing. A concentrate of the active ingredients of such a Stage 4 treatment also maintains its effectiveness for longer than do similar produels when stored at high ambient temperatures.

20 Claims, No Drawings

AQUEOUS LUBRICANT AND SURFACE CONDITIONER, WITH IMPROVED STORAGE STABILITY AND HEAT RESISTANCE, FOR METAL SURFACES

BACKGROUND OF THE INVENTION

1. Field of the Invention

This invention relates to a lubricant and surface conditioner for metal surfaces, more particularly metal surfaces already in the size and shape of their intended consumer use (such surfaces sometimes being briefly denoted hereinafter as "formed"), still more particularly to such a lubricant and surface conditioner which improves the mobility of aluminum cans without adversely affecting the adhesion of paints or lacquers applied thereto; maintains this mobility enhancing effect even if subjected to more than normal heating, for example if a can production and cleaning line stalls temporarily in such a fashion as to leave some cans in the drying oven for several times longer than in normal production; and is reasonably stable in storage under normal warm to hot conditions, even when all the active ingredients are stored together.

2. Discussion of Related Art

Aluminum cans are commonly used as containers for a wide variety of products, especially beverages. In the most widely used current commercial practice, at least for large scale operations, the aluminum cans are typically washed with acidic cleaners to remove aluminum fines and other contaminants therefrom. More particularly, aluminum cans are subjected to a succession of six cleaning and rinsing operations as described in Table 1 below.

TABLE 1

| STAGE NUMBER | ACTION ON SURFACE DURING STAGE |
|---|---|
| 1 | Aqueous Acid Precleaning |
| 2 | Aqueous Acid and Surfactant Cleaning |
| 3 | Tap Water Rinse |
| 4 | Mild Acid Postcleaning, Conversion Coating, or Tap Water Rinse |
| 5 | Tap Water Rinse |
| 6 | Deionized ("DI") Water Rinse |

The cleaning of aluminum cans generally results in differential rates of metal surface etch on the outside versus on the inside of the cans. For example, optimum conditions required to attain an aluminum fine-free surface on the inside of the cans usually leads to can mobility problems on conveyors because of the increased roughness on the outside can surface, unless some material to avoid this problem is put into place on the outside surface of the cleaned cans.

These aluminum can mobility problems are particularly apparent when it is attempted to convey the cans through single filers and to printers. Thus, a need has arisen in the aluminum can manufacturing industry to modify the coefficient of static friction (hereinafter often abbreviated as "COF") on at least the outside surface of the cans to improve their mobility. The reason for improving the mobility of aluminum cans is the general trend in this manufacturing industry to increase production without additional capital investments in building new plants. The increased production demand is requiring can manufitcturers to increase their line and printer speeds to produce 20 to 40 percent more cans per unit of time. For example, the maximum speed at which aluminum cans, in the absence of any treatment to reduce their coefficient of surface friction, may be passed through a printing station typically is on the average of about 1150 cans per minute, whereas it is desired that such rate be increased to about 1400 to 1500 cans per minute or even higher.

However, aluminum cans thoroughly cleaned by either acid or alkaline cleaner are, in general, characterized by high surface roughness and thus tend to have a high coefficient of static friction. This property hinders the flow of cans through single filers and printers when attempting to increase their line speed. As a result, printer misfeeding problems, frequent jammings, down time, and loss of production can occur in addition to high rates of can spoilage.

Another consideration in modifying the surface properties of aluminum cans is the concern that such modification may interfere with or adversely affect the ability of the can to be printed when passed to a printing or labeling station. For example, after cleaning the cans, labels may be printed on their outside surface, and lacquers may be sprayed on their inside and/or outside surface. In such a case, the adhesion of the paints and lacquers is of major concern.

It is currently possible to produce a can which is satisfactorily mobile and to which subsequently applied inks and/or lacquers have adequate adhesion by using suitable surfactants either in Stage 4 or Stage 6 as noted above. Preferred treatments for use in Stage 6 are described in U.S. Pat. Nos. 4,944,889 and 4,859,351 and in U.S. application Ser. No. 07/910,483, and some of them are commercially available from the Parker+Amchem Division of Henkel Corporation (hereinafter often abbreviated as "P+A") under the name ME-40®. However, many manufacturers have been found to be reluctant to use chemicals such as ME−40® in Stage 6. In some cases, this reluctance is due to the presence of a carbon filter for the DI water (normal Stage 6) system, a filter that can become inoperative by adsorption of chemicals such as those in ME−40®; in other cases, it is due to a reluctance to make the engineering changes necessary to run ME−40.

The above noted U.S. patent application, along with U.S. Pat. Nos. 5,030,323 and 5,064,500, also describes preferred treatments for use in Stage 4, and some of these materials are commercially available from P+A under the name FIXODINE® 500. However, the reduction in coefficient of friction provided by the latter treatment can be substantially reduced, often to an unacceptable level, if the treated cans are subjected to extraordinary heating after completion of the six process stages described above. Such extraordinary heating of the cans in the drying oven occurs whenever a high speed production line is stalled for even a few minutes, an event that is by no means rare in practice. In practical terms, the higher COF measurements correlate with the loss of mobility, thereby defeating the purpose of introducing mobility enhancing surfactants into Stage 4 can washing formulations.

It has also been observed that the coefficient of friction on can surfaces is less effectively reduced by FIXODINE® 500 if the commercially supplied concentrate(s), especially if supplied as a single concentrate containing all the required ingredients except water, but even if supplied in two separate packages with most of the acid content in a separate package from the phosphate ester component needed, is stored for several weeks at temperatures at or above 45° C., which can easily be reached in storage areas in summer in most of the United States.

A major object of the invention is to provide adequate mobility enhancement without practically significant deterioration of subsequent adhesion to the treated surface by printing ink or lacquer, as little deterioration as possible of this mobility enhancement under extended heating at temperatures typical for drying ovens on high speed can lines, and stability to storage in hot weather of a concentrate or pair of concentrates suitable for diluting with water to make the working solution for direct treatment of cans, suitable for use in Stage 4 as defined above, and without requiring the use of any additive to the DI water used in Stage 6.

DESCRIPTION OF THE INVENTION

Other than in the operating examples, or where otherwise indicated, all numbers expressing quantities of ingredients or reaction conditions used herein are to be understood as modified in all instances by the term "about" in describing the broadest scope of the invention. Practice within the exact numerical limits given, however, is generally preferred.

Also, unless there is an explicit statement to the contrary, the description below of groups of chemical materials as suitable or preferred for a particular ingredient according to the invention implies that mixtures of two or more of the individual group members are equally as suitable or preferred as the individual members of the group used alone. Furthermore, the specification of chemical materials in ionic form should be understood as implying the presence of some counterions as necessary for electrical neutrality of the total composition. In general, such counterions should first be selected to the extent possible from the ionic mateddais specified as part of the invention; any remaining counterions needed may generally be selected freely, except for avoiding any counterions that are detrimental to the objects of the invention.

SUMMARY OF THE INVENTION

In accordance with this invenlion, it has been found that a suitable single package additive to satisfy the objective stated above comprises, preferably consists essentially of, or more preferably consists of:

(A) a dissolved phosphorus containing surfactant component that is a mixture of molecules conforming to the general formula I:

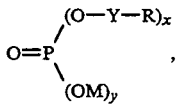

(I)

where M is selected from the group consisting of H, alkali metal cations, monovalent fractions of alkaline earth metal cations, and monovalent fractions of ammonium and substituted ammonium cations, or preferably from the group consisting of H and alkali metal cations; $x=1$ or 2 and $y=3-x$; Y is an alkylenc or alkylcnc other group, which may be branched or unbranched, with its open valences on carbon atoms and with from 2 to 12, preferably from 2 to 4, most preferably 2, carbon atoms and up to 3, preferably no more than one, more preferably no oxygen atoms; and R is an imidazoline moiety conforming to general formula II:

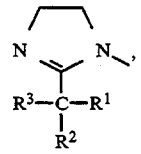

(II)

where each of $R^1$ and $R^2$ is independently selected, except that $R^1$ and $R^2$ may not both be hydrogen, from the group consisting of hydrogen, a moiety derived from propionitrile by removing a hydrogen atom from the $—CH_3$ group thereof, and moieties of the general formula III:

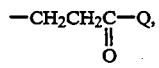

(III)

where Q is selected from the group consisting of —OM, $—NH_2$, and $—OR^4$, where M has the sanme meaning as defined above and $R^4$ represents a $C_{2-2}$ alkyl, alkylaryl, or alkylcycloalophatic moiety; preferably, $R^1$ and $R^2$ are selected from the group consisting of hydrogen and moieties of general formula III when Q=OM and M=H or an alkali metal ion; and $R^3$ is selected from the group consisting of unsubstituted and hydroxy substituted aliphatic and cycloaliphatic and alkylaryl moieties, or preferably from the group consisting of unsubstituted and unbranched aliphatic moieties, having from 2 to 22 carbon atoms; with increasing preference in the order given, at least 50, 64, 76, or 84 mole percent of the total $R^3$ groups in the composition have from 8 to 20, or more preferably from 10 to 14, carbon atoms;

(B) a component selected from the group of water soluble salts containing ions that comprise atoms selected from the group consisting of Zr, Ti, Sn, Al, and Fe;

(C) a metal etching component, preferably selected from the group consisting of nitric, sulfric, phosphoric, hydrofluoric, hydrochloric, hydrobromic, and hydroiodic acids; acid salts of sulfuric, phosphoric, and hydrofluoric acids; and salts of nitric, sulfuric, phosphoric, hydrofluoric, hydrochloric, hydrobromic, and hydroiodic acids with bases having an ionization product constant less than that of the acid with which they form the salt; and (D) "free fluoride ions"; and, optionally, any one or more of the following:

(E) a component selected from molecules conforming to general formula IV:

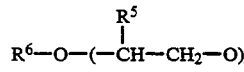

(IV)

wherein $R^6$ is a linear, cyclic, or branched saturated monovalent aliphatic hydrocarbon moiety containing from 1 to 25, preferably from 4–20, carbon atoms; X is selected from the group consisting of hydrogen, halogen, phenyl, and $R^5$; s is an integer from 1 to 50, preferably from 1 to 20; and $R^5$ is selected from the group consisting of hydrogen and alkyl groups containing 1–4 carbon atoms, preferably from hydrogen and methyl, most preferably hydrogen;

(F) a component selected from molecules conforming to general formula V:

$$R^7-(C_6H_4)-O-(-\overset{R^5}{\overset{|}{C}}H-CH_2-O)_s-H, \quad (V)$$

wherein $R^7$ is a linear, cyclic, or branched saturated monovalent aliphatic hydrocarbon moiety containing from 4 to 25, preferably from 8 to 12, most preferably 9, carbon atoms; $(C_6H_4)$ is an ortho-, meta-, or para-phenylene nucleus; and $R^5$ and s have the same meaning as for formula IV;

(G) a component selected from molecules conforming to general formula VI:

$$R^8-\overset{O}{\overset{\|}{C}}-O-(-\overset{R^5}{\overset{|}{C}}H-CH_2-O)_s-H, \quad (VI)$$

wherein $R^8$ is a linear or branched, saturated or unsaturated monovalent aliphatic hydrocarbon moiety containing from 1 to 25, preferably from 4–20, carbon atoms; and $R^5$ and s have the same meaning as in formula IV;

(H) a component selected from chelating agents for the metal containing ions of component (B), preferably selected from the group consisting of molecules, including polymer molecules, each containing at least two moieties selected from group consisting of amino, substituted amino, carboxyl, phosphonate, sulfonate, and carbonyl moieties; and (J) an antimicrobial agent.

It should be noted that not all of the specified components must be separate materials. For example, fluozirconic acid (i.e. $H_2ZrF_6$) can serve as both component (B) and component (C), and ammonium bifluoride or hydrofluoric acid can serve as both components (C) and (D). Also, the same components as specified above for a single package additive may be, and often preferably are, comprised instead in a pair of two distinct additives. For maximum storage stability, a two package additive pair, with most or all of the metal etching component (C) as defined above in a separate package from the other ingredients, is generally preferred.

Components (E), (F), and (G) as defined above are generally used only when their action as an antifoam agent is desired or needed, because of a foaming tendency of compositions containing the four required components (A)–(D). Component (H) is generally included only when needed to solubilize the desired concentration of component (B). Component (J) is generally used only if needed to avoid growth of microorganisms in the compositions when they are used.

Various embodiments of the invention include a concentrated additive or pair of additive compositions as described above; a solution of such an additive composition or pair of additive compositions in water, optionally with additional acid or base to adjust the pH value, suitable as the complete composition for contacting the metal surfaces in Stage 4 of a six stage cleaning and rinsing process as described above; and processes including contacting a metal surface, particularly an aluminum surface, with an aqueous composition including the ingredients of the additive composition specified in detail above. The working compositions for Stage 4 as described above, in addition to the components included by virtue of dilution of a concentrated additive or additive package as specified above may also contain aluminate anions, including fluoroaluminate anions; and aluminum cations, including complex fluoroaluminum cations. Such components are often present in practice in small amounts as a result of dragout from Stages 2 and B into Stage 4 during practical large scale operations.

DESCRIPTION OF PREFERRED EMBODIMENTS

For necessary components (A) and (B), certain minimum concentrations are strongly preferred in order to obtain optimum surface characteristics on the treated surfaces, and large excesses over these minimum concentrations have not been observed to do any harm in so far as the quality of the treatments is concerned. However, since a certain amount of the treatment compositions will be lost in normal processing, it is economically advantageous to avoid overwhelmingly large concentrations of these components, which would increase the amount wasted. For necessary components (C) and (D), in contrast, very large concentrations can cause surface damage as well as being uneconomical.

Irrespective of its detailed composition, the composition with which a formed aluminum surface is contacted during a process according to this embodiment of this invention preferably contains from 0.001 to 10 % by weight ("w/o"), more preferably 0.005–0.05 w/o, of the total of components (A), (B), (C), and (D) as described above, with optional components and water making up the balance. The water used need not necessarily be deionized or otherwise specially purified; ordinary tap water usually gives satisfactory results. The pH of the composition during contact with a formed aluminum surface preferably is in the range of 1–8, more preferably in the range of 2–5. The pH may be adjusted as needed, preferably with nitric and/or sulfuric acid, during use, in order to maintain the pH within the desired range. The temperature of the composition during contact with the formed aluminum surface is preferably from 10°–85° C., more preferably from 21°–54° C. Contact may be by spraying, immersion, or any other convenient method or mixture of methods. Preferably the time of contact is from 5–60, more preferably from 20–30, seconds.

The "Free fluoride ion" activity for purposes of this invention is defined and can conveniently be measured, and monitored during use if desired, by means of fluoride sensitive electrode as described in U.S. Pat. No. 3,43 1,182 and commercially available from Orion Instruments. "[Free]fluoride ion activity" as this term is used herein was measured relative to a 120E Activity Standard Solution commercially available from the Parker+Amchem ("P+A") Division of Henkel Corporation by a procedure described in detail in P+A Technical Process Bulletin No. 968. The Orion Fluoride Ion Electrode and the reference electrode provided with the Orion instrument are both immersed in the noted Standard Solution and the millivolt meter reading is adjusted to 0 with a Standard Knob on the instrument, after waiting if necessary for any drift in readings. The electrodes are then rinsed with deionized or distilled water, dried, and immersed in the sample to be measured, which should be brought to the same temperature as the noted Standard Solution had when it was used to set the meter reading to 0. The reading of the electrodes immersed in the sample is taken directly from the millivolt (hereinafter often abbreviated "mv") meter on the instrument. For a working composition, i.e., a composition suitable as such for use in Stage 4 of a processing sequence as defined above, according to this invention, the fluoride ion activity preferably is such as to result in a meter reading, with increasing preference in the order given, within the range from −50 to −130 mv, −60 to −120 mv, −75 to −105 mv, or −85 to −95 mv.

Any antimicrobial or biocidal agent, except those having some detrimental effect on the mobility enhancing properties or the stability of the composition, may advantageously be added to the compositions as previously taught herein in an amount sufficient to effectively inhibit the growth of microorganisms. Hydrogen peroxide is generally most preferred for this purpose. In aqueous concentrated compositions, suitable for dilution with about 99 times their own weight of water to make a composition ready for direct application to metal to enhance mobility after drying, as already described, concentrations of hydrogen peroxide in the range from 0. 375 to 3.75 w/o are preferred, with concentrations in the range frons 1.4 to 2.2 w/o most preferred. In more concentrated compositions the preferred biocide concentrations would be determined by the expected degree of dilution of the concentrate. In general, however, because of the relatively low stability of concentrated hydrogen peroxide, it is preferred that this component, if used, be added only to a sufficiently dilute concentrate that the concentration of hydrogen peroxide does not exceed about 3 w/o at the time of making up the composition.

Any antifoam agent, except those which have some detrimental effect on the mobility enhancing properties already described or the stability of the compositions, may advantageously be added when needed to the compositions as previously taught herein, in an amount effective to decrease the amount of foaming observed during preparation and/or use of the compositions. Generally, silicone antifoam agents are not desirable for use with this invention because they tend to cause formation of water breaks. Preferably, the antifoam agents correspond to one of general formulas IV, V, and VI as given above, most preferably to formula IV. In a working composition for a Stage 4 bath, the amount of total antifoam agent is preferably from 0.0001 to 0.05 w/o, more preferably from 0.001 to 0.01 w/o, or still more preferably from 0.002 to 0.008 w/o.

The characteristics of and methods of making phosphorus containing surfactants as required for component (A) of a composition according to this invention are described in detail in U.S. Pat. No. 4,490,536 of Dec. 25, 1984 to Corti et al. The most preferred constituents for component (A) are those in which $R^3$ in general formula II represents straight chain unsubstituted and saturated alkyl groups. Independently, the most preferred constituents for component (A) are those in which M in general formula I represents an alkali metal cation.

For component (B) the most preferred constituent is fluozirconic acid, i.e. $H_2ZrF_6$, and/or fluozirconate salts, and it is preferred that component (C) and/or (D) include bifluoride ions, i.e., $HF_2$ ions. Also, components of type (E) are preferred over those of types (IF) and (G), primarily because they lead to working compositions that have less tendency to generate foam.

It is preferred that the amount of component (A) in a solution used for treating according to this embodiment of this invention be such as to provide a concentration of at least 0.000012, or, with increasing preference in the order given, at least 0.000025, at least 0.000051, or at least 0.00019, gram atoms of phosphorus per liter. Independently, primarily for cost reasons as already noted, it is preferred that the amount of component (A) in such a working composition should not exceed the amount necessary to provide 0.005, more preferably 0.001, or still more preferably 0.0003 1, gram atoms of phosphorus per liter. It is also independently preferred that the amount of component (B) in a solution used for treating according to this embodiment of this invention a concentration of at least from 0.00002, or, with increasing preference in the order given, at least 0.000042, at least 0.000097, or at least 0.00038 gram atoms per liter of the total of all of the metal atoms recited in component (B). Independently, it is preferred that the amount of component (B) in such a working composition should not exceed the amount necessary to provide 0.005, more preferably 0.002, or still more preferably 0.00059, gram atoms per liter of the total of all of the metal atoms recited in component (B).

In addition to the values for "free fluoride ion activity" already given, it is independently preferred that the total concentration of fluorine atoms in components of the composition selected from the group consisting of fluoride ions, bifluoride salts, and hydrogen fluoride in a working composition according to this invention should be at least 0.00001, or, with increasing preference in the order given, at least 0.000051, at least 0.00012, at least 0.00029, or at least 0.0011, gram atoms of fluorine per liter.

For concentrates, the concentrations of all ingredients other than water are preferably 5 to 1000, more preferably 40 to 400, still more preferably 105 to 215, or most preferably 150 to 170, times higher than the values given above.

In a process according to the invention, the amount of material added on to the treated surface during exposure to a composition according to the invention preferably is sufficient to cause the COF of the surface as finally processed to be not greater than 1.5, more preferably not greater than 1.2, still more preferably not greater than 1.0, and most preferably not greater than 0.8. Also, independently, the COF of the surface as treated according to this invention preferably is not greater than 90% of the value that the surface would have had if treated in the same way, except for substituting contact with deionized water for contact with a composition according to this invention.

The invention may be further appreciated by consideration of the following examples and comparison examples, which are intended to be merely descriptive, illustrative, and not limiting as to the scope of the invention, except to the extent that any limitations given in the examples may be repeated in the appended claims.

GENERAL CONDITIONS FOR EXAMPLES AND COMPARISON EXAMPLES

All the process examples and comparison examples described below in this group used aluminum cans as substrates and a laboratory prototype simulation of a commercial six stage processor. Each run was made with 14 cans. The process sequence used is described in Table 2.

TABLE 2

| Stage Number | Times in Seconds for: Spray | Dwell | Blow-Off | Temperature, °C. | Composition |
|---|---|---|---|---|---|
| 1 | 30 | 10 | 30 | 54.4 | Aqueous $H_2SO_4$ |

TABLE 2-continued

| Stage Number | Times in Seconds for: Spray | Dwell | Blow-Off | Temperature, °C. | Composition |
|---|---|---|---|---|---|
| | | | | | to give pH = 2. |
| 2 | 90 | 10 | 30 | 60.0 | See Notes for this table below. |
| 3 | 30 | 10 | 30 | 22 ± 4 | Tap water |
| 4 | 20 | 20 | 30 | 37.8 | Varies; see details below. |
| 5 | 30 | 0 | 0 | 22 ± 4 | Tap water rinse |
| 6 | 90 | 0 | 30 | 22 ± 4 | DI water rinse |

Notes for Table 2
The composition for Stage 2 contained (i) a commercially available sulfuric acid and surfactant cleaner (RIDOLINE ® 124-C from the Parker + Amchem Div. of Henkel Corp., Madison Heights, Michigan) at a concentration to give 3.4 grams per liter of total surfactant and (ii) hydrofluoric acid, and if needed, additional sulfuric acid to give a free acid value of 15 points and a fluoride ion activity reading of −10 mv, using the Orion instrument and associated electrodes as in the main text above. The free acid points are determined by titrating a 10 milliliter (hereinafter often abbreviated "ml")sample of the composition, dissolved in about 100 ml of distilled water, with 0.10 N NaOH solution, using a phenolphthalein indicator after dissolving a large excess of sodium fluoride (about 2–3 ml bulk volume of powdered dry reagent) in the sample before titrating. The points of free acid are equal to the number of ml of titrant required to reach a faint pink end point.

Stage 4 compositions were prepared either by dilution of concentrate or directly from the ingredients. Concentrate compositions, either single or two package, are defined in connection with the particular examples below.

Cans washed and rinsed according to the six stage process described above were dried for 5 minutes at 150° C. under normal conditions. When heat resistant mobility was being tested, the cans, after the normal drying noted immediately above, were placed in a 200° C. oven for an additional 5 minutes. These two drying conditions were identified as single and double baked cans, respectively.

All determinations of coefficient of friction were made in the manner described in lines 44–65 of U.S. Pat. No. 4,944,889 and were the average of 15 individual measurements.

EXAMPLE AND COMPARISON EXAMPLE GROUPS 1

To test the heat stability of concentrates according to the invention, 1000 grams of single package concentrate were made up and placed in a constant temperature water bath controlled to 48.9±0.6° C. (120±1° F.). Fifty milliliter (hereinafter often abbreviated as "mL") samples were removed and diluted to 8 liters (hereinafter often abbreviated "L") for use in the Stage 4 bath. Prior to addition of the substrate cans, 9.6 grams of aluminum sulfate (=100 ppm of $Al^{+3}$) were dissolved in the Stage 4 bath. Before addition of the final amount of water, the fluoride activity ($F^-$) was adjusted to −90 mv vs Activity Standard Solution 120 E (commercially available from P+A) and the pH to 2.7 by the addition of concentrated aqueous sulfuric and/or hydrofluoric acid if needed. A set of 14 cans was washed and dried about once each week. The COF of the washed and dried cans was measured and if the value was ≦1.0, the primary concentrate was returned to the water bath for another week.

The compositions of the single package type concentrates used for this group are shown in Table 3, except that the particular ingredients used for component (A) or a comparison with it in this group of experiments are shown in Table 4, as are the coefficients of friction obtained with freshly made working compositions using these ingredients, and the weeks of stability of the concentrates obtained with these ingredients. More detailed data from which the lifetime data in Table 4 were derived are shown in Table 5.

TABLE 3

GENERAL COMPOSITION OF CONCENTRATE USED TO PREPARE WORKING SOLUTIONS FOR EXAMPLE AND COMPARISON EXAMPLE GROUP I

| Component | Grams of Component per Kilogram of Concentrate |
|---|---|
| Component (A) or other phosphorus-containing surfactant | 120.6 |
| Fluozirconic acid | 35.7 |
| Ammonium bifluoride | 6.3 |
| IGEPAL ® CO-887 | 7.7 |
| Deionized ("DI") water | balance |

Notes for Table 3
IGEPAL ® CO-887 is commercially available from Rhône-Poulenc Corp, Cranbury, New Jersey 08512, USA, and is reported to contain as its active ingredient ethoxylated nonyl phenols.

TABLE 4

| PHOSPHATE ESTER | COF - SB | COF - DB | WEEKS STABLE AT 48.9° C. | COMMENTS |
|---|---|---|---|---|
| ETHOX ® 2684 | 0.527 | 0.967 | 3–4 | |
| PHOSPHOTERIC ® TC-6 | 0.576 | 0.635 | ≧13 | |
| PHOSPHOTERIC ® TL-3K | 0.727 | NA | ≧8 | |
| TRYFAC ® 5560 | 0.583 | 0.698 | NA | Severe water break |

Notes for Table 4
"SB" = single bake; "DB" = double bake; "NA" = not available. ETHOX ® 2684, commercially available from Ethox Chemicals, Inc., Greenville, South Carolina 20606, USA, is reported by its supplier to be a monoesterified phosphoric acid with the alcohol moieties derived from a mixture of $C_{8-10}$ linear monoalcohols condensed with an average of about 6 moles of ethylene oxide per mole of alcohol. PHOSPHOTERIC ® TC-6 and TL-3K are available from Mona Industries, Patterson, New Jersey and are both reported by their supplier to be carboxyethylphosphoimidazol salts with long substituents (group $R^3$ in formula (II) above); the former is a sodium salt with long alkyl substituents derived from natural coconut oils and the latter is a potassium salt with its long alkyl substituents being lauryl groups. TRYFAC ® 5560 is commercially available from Henkel Corporation__.

TABLE 5

EFFECT OF STORAGE TIME AT 48.9° C. ON ABILITY OF COMPOSITIONS IN EXAMPLE AND COMPARISON EXAMPLE GROUP I TO REDUCE THE COEFFICIENT OF FRICTION ON ALUMINUM CANS

| Days of Storage at Temperature | Coefficient of Friction after Noted Time with: ETHOX ® 2684 | PHOSPHOTERIC ® TL-3K | PHOSPHOTERIC ® TC-6 |
|---|---|---|---|
| 1 | 0.55 | 0.60 | 0.58 |
| 9 | 0.62 | 0.61 | 0.58 |
| 16 | 0.87 | 0.72 | 0.58 |
| 22 | 0.92 | 0.70 | 0.58 |
| 29 | 1.39 | 0.65 | 0.58 |
| 36 | | 0.65 | 0.58 |
| 43 | | 0.92 | 0.58 |
| 50 | | nm | 0.58 |
| 57 | | 0.78 | 0.58 |
| 64 | | 0.80 | 0.58 |
| 71 | | | 0.58 |
| 78 | | | 0.58 |
| 92 | | | 0.58 |

The severe water breaks observed with TRYFAC ® 5560 would seriously limit its commercial acceptability. The other three materials are all commercially satisfactory when freshly made, but the two PHOSPHOTERIC ® materials according to the invention last considerably longer in hot storage than the ETHOX ® material.

EXAMPLES GROUP 2

In this group, only the PHOSPHOTERIC ® TC-6 material (as described under Group 1) was used as component (A). The single package type concentrate had the same composition as when made with this particular component (A) for Group 1, but the amount of concentrate used to make the working solutions was varied to include lower amounts than in Group 1. Table 6 shows the resulting concentrations in the concentrate and in the least dilute of the five working concentrations employed in this group, and Table 7 shows the effect of varying the concentration of concentrate in the working Stage 4 composition. The volumes of concentrate shown in Table 7 were diluted with DI water to make 8 L of working solution, after additions of aluminum salt and adjustment of pH and free fluoride activity values if needed, as described for Group 1. The results indicate that there is little difference in the results achieved at any of these concentrations under ideal drying conditions, corresponding to single bake values in the Table, but that the three lower values in the Table produce working compositions that are less tolerant of extraordinary heating of the treated cans during processing.

TABLE 6

INGREDIENTS, THEIR MOLECULAR WEIGHTS, AND CONCENTRATIONS FOR EXAMPLE GROUP 2

| Ingredient | Approximate Molecular Weight | Moles per Kilogram in Concentrate | Moles per Liter in Working Composition |
|---|---|---|---|
| PHOSPHOTERIC ® TC-6 (35 w/o Active) | 1125 | 0.0375 | 0.000234 |
| Fluozirconic Acid (45% Active) | 207 | 0.0776 | 0.000485 |
| Ammonium Bifluoride | 57 | 0.1105 | 0.00069 (= 0.00138 gram atoms of F) |
| IGEPAL ® CO-887 | 1540 | 0.005 | 0.000031 |

TABLE 7

EFFECT OF CONCENTRATE COMPOSITION ON COEFFICIENT OF FRICTION VALUES OBTAINED WITH NORMAL AND EXTRAORDINARY HEATING

| Milliliters of Concentrate | COF - SB | COF - DB |
|---|---|---|
| 50 | 0.600 | 0.731 |
| 40 | 0.597 | 0.725 |
| 30 | 0.615 | 0.848 |
| 20 | 0.705 | 0.885 |
| 10 | 0.634 | 1.074 |

EXAMPLES GROUP 3

In this group, two package type concentrates were used. The primary concentrate contained 120.5 grams of PHOSPHOTERIC ® TC-6 per kilogram of concentrate and in some cases also contained 7.6 grams of one of TRYCOL ® LF-1 and TRITON ® DF-16, which are both alkyl polyethers commercially available from Henkel Corporation and Union Carbide respectively; in some cases, the primary concentrate contained no surfactant, other than component (A); in all cases, the balance of the primary concentrate was DI water. The secondary concentrate consisted of 44.7 grams of ammonium bifluoride and 34.5 grams of fluozirconic acid per kilogram of secondary concentrate, with the balance DI water. An amount of 50 mL of primary concentrate was used in each case, along with an equal amount or half of an equal amount of the secondary concentrate. The mixed primary and secondary concentrates were diluted with DI water to 8 L. after additions of aluminum salts and adjustment of the pH and free fluoride values to the same levels as in the preceding Groups. The amount and type of surfactants and of primary and secondary concentrates used are shown in Table 8. as arc the COF values obtained and the turbidity of the solution. The compositions with alternative surfactants had less turbidity and were also less inclined toward undesirable foaming during use than those made with no surfactant other than component (A) or with IGEPAL ® CO-887.

TABLE 8

RESULTS FROM EXPERIMENT GROUP 3

| Ratio by Weight of Primary to Secondary Concentrate | Surfactant | COF - SB | COF - DB | Turbidity |
|---|---|---|---|---|
| 1:1 | None | 0.659 | 0.853 | Cloudy |
| 1:1 | DF-16 | 0.593 | 0.736 | Slightly Cloudy |
| 1:1 | LF-1 | 0.611 | 0.669 | Slightly Cloudy |
| 2:1 | None | 0.612 | 0.831 | Cloudy |
| 2:1 | DF-16 | 0.562 | 0.779 | Slightly Cloudy |
| 2:1 | LF-1 | 0.573 | 0.694 | Slightly Cloudy |

The invention claimed is:

1. A liquid composition of matter consisting essentially of water and:

(A) a dissolved phosphorus containing surfactant component that is a mixture of molecules conforming to the general formula I:

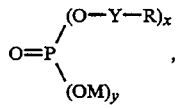

(I)

where M is selected from the group consisting of H, alkali metal cations, monovalent fractions of alkaline earth metal cations, and monovalent fractions of ammonium and substituted ammonium cations; x=1 or 2 and y=3−x; Y is an alkylene or alkylene other group, which may be branched or unbranched, with its open valences on carbon atoms and with from 2 to 12 carbon atoms and up to 3 oxygen atoms; and R is an imidazoline moiety conforming to generally formula H:

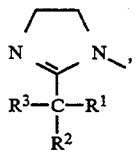

(II)

where each of $R^1$ and $R^2$ is independently selected, except that $R^1$ and $R^2$ may not both be hydrogen, from the group consisting of hydrogen, a moiety derived from propionitrile by removing a hydrogen atom from the $—CH_3$ group thereof, and moieties of the general formula III:

$$-CH_2CH_2\underset{\underset{O}{\|}}{C}-Q, \quad \text{(III)}$$

where Q is selected from the group consisting of —OM, —$NH_2$, and —$OR^4$, where M has the same meaning as defined above and $R^4$ represents a $C_{2-12}$ alkyl, alkylaryl, or alkylcycloaliphatic moiety; and $R^3$ is selected from the group consisting of unsubstituted and hydroxy substituted aliphatic and cycloaliphatic and alkylaryl moieties having from 2 to 22 carbon atoms;

(B) a component selected from the group of water soluble salts containing ions that comprise atoms selected from the group consisting of Zr, Ti, Sn, Al, and Fe;

(C) a metal etching component; and (D) "free fluoride ions"; and, optionally, any one or more of the following:

(E) a component selected from molecules conforming to general formula IV:

$$R^6-O-(-\underset{}{\overset{R^5}{\overset{|}{C}}}H-CH_2-O)_s-X, \quad \text{(IV)}$$

wherein $R^6$ is a linear, cyclic, or branched saturated monovalent aliphatic hydrocarbon moiety containing from 1 to 25 carbon atoms; X is selected from the group consisting of hydrogen, halogen, phenyl, and $R^5$; s is an integer from 1 to 50; and $R^5$ is selected from the group consisting of hydrogen and alkyl groups containing 1–4 carbon atoms;

(F) a component selected from molecules conforming to general formula V:

$$R^7-(C_6H_4)-O-(-\overset{R^5}{\overset{|}{C}}H-CH_2-O)_s-H, \quad \text{(V)}$$

wherein $R^7$ is a linear, cyclic, or branched saturated monovalent aliphatic hydrocarbon moiety containing from 4 to 25 carbon atoms; $(C_6H_4)$ is an ortho-, meta-, or para-phenylene nucleus; and $R^5$ and s have the same meaning as for formula IV;

(G) a component selected from molecules conforming to general formula VI:

$$R^8-\overset{O}{\overset{\|}{C}}-O-(-\overset{R^5}{\overset{|}{C}}H-CH_2-O)_s-H, \quad \text{(VI)}$$

wherein $R^8$ is a linear or branched, saturated or unsaturated monovalent aliphatic hydrocarbon moiety containing from 1 to 25 carbon atoms; and $R^5$ and s have the same meaning as in formula IV;

(H) a component selected from chelating agents for the metal containing ions of component (B); and (J) an antimicrobial agent.

2. A composition according to claim 1, wherein the amount of component (A) is such as to provide from about 0.000060 to about 5 gram atoms of phosphorus per liter of composition; the amount of component (B) is such as to provide from about 0.00010 to about 5 gram atoms of the total of Zr, Ti, Sn, Al, and Fe per liter of composition; component (A) is selected from molecules conforming to general formula I when the "Y" groups contain from 2 to 4 carbon atoms and no oxygen atoms, $R^1$ and $R^2$ are selected from the group consisting of hydrogen and moieties of general formula III when Q=OM and M is hydrogen or an alkali metal, and at least 50 mole percent of the total $R^3$ groups in the composition have from 8 to 20 carbon atoms.

3. A composition according to claim 2, wherein the amount of component (A) is such as to provide at least about 0.0010 gram atoms of phosphorus per liter of composition; the amount of component (B) is such as to provide at least about 0.0017 gram atoms of the total of Zr, Ti, Sn, Al, and Fe per liter of composition; and the concentration of fluorine atoms in ingredients of the composition selected from the group consisting of fluoride ions, bifluoride salts, and hydrogen fluoride is at least about 0.0020 gram atoms per liter of fluorine atoms.

4. A composition according to claim 3, the amount of component (A) is such as to provide from about 0.0010 to about 0.40 gram atoms of phosphorus per liter of composition; component (B) includes dissolved fluozirconic acid, fluozirconate ions, or both fluozirconic acid and fluozirconate ions; and the amount of component (B) is such as to provide at least about 0.0039 gram atoms of Zr per liter of composition.

5. A composition according to claim 4, wherein component (A) is selected from molecules conforming to general formula I when Y is an ethylene group and at least 76 mole percent of the total $R^3$ groups have from 10 to 14 carbon atoms and are unsubstituted and unbranched alkyl groups; the amount of component (A) is such as to provide at least about 0.020 gram atoms of phosphorus per liter of composition; the amount of component (B) is such as to provide at least about 0.0040 gram atoms of Zr per liter of composition; the amount of component (C) is such as to provide from about 0.21 to about 11 gram atoms per liter of fluoride atoms; and the amount of component (D) is in the range from about 0.10 to about 2.2 w/o.

6. A composition according to claim 5, wherein the nature and amount of component (B) are such as to provide from about 0.057 to about 0.103 gram atoms of Zr per liter of composition, and The amount of component (C) is such as to provide from about 0.9 to about 2.4 gram atoms per liter of fluoride atoms.

7. A composition according to claim 1, wherein the pH is from about 1 to about 8; the amount of component (A) is such as to provide from about 0.000012 to about 0.005 gram atoms of phosphorus per liter of composition; the amount of component (B) is such as to provide from about 0.00002 to about 0.005 gram atoms of the total of Zr, Ti, Sn, Al, and Fe per liter of composition; the fluoride ion activity is such as to result in a fluoride ion activity meter reading within the range from about −50 to about −130 mv; component (A) is selected from molecules conforming to general formula I when the "Y" groups contain from 2 to 4 carbon atoms and no oxygen atoms, $R^1$ and $R^2$ are selected from the group consisting of hydrogen and moieties of general formula III when Q=OM and M is hydrogen or an alkali metal, and at least 50 mole percent of the total $R^3$ groups in the composition have from 8 to 20 carbon atoms.

8. A composition according to claim 7, wherein the amount of component (A) is such as to provide at least about 0.000025 gram atoms of phosphorus per liter of composition; the amount of component (B) is such as to provide at least about 0.000042 gram atoms of the total of Zr, Ti, Sn, Al, and Fe per liter of composition; the fluoride ion activity is such as to result in a fluoride ion activity meter reading within the range from about −60 to about −120 mv; and the concentration of fluorine atoms in ingredients of the composition selected from the group consisting of fluoride ions, bifluoride salts, and hydrogen fluoride is at least about 0.000051 gram atoms per liter of fluorine atoms.

9. A composition accorcling to claim 8, wherein the pH is in the range from about 2.0 to about 5.0; the amount of component (A) is such as to provide from about 0.000051 to about 0.001 gram atoms of phosphorus per liter of composition; component (B) includes dissolved fluozirconic acid, fluozirconate ions, or both fluozirconic acid and fluozirconate ions; and the amount of component (B) is such as to provide at least about 0.000097 gram atoms of Zr per liter of composition.

10. A composition according to claim 9, wherein component (A) is selected from molecules conforming to general formula I when Y is an ethylene group and at least 76 mole percent of the total $R^3$ groups have from 10 to 14 carbon atoms and are unsubstituted and unbranched alkyl groups; the amount of component (A) is such as to provide at least about 0.00019 gram atoms of phosphorus per liter of composition; the amount of component (B) is such as to provide at least about 0.00038 gram atoms of Zr per liter of composition; the amount of component (C) is such as to provide from about 0.001 to about 0.025 gram atoms per liter of hydrogen ions and from about 0.002 to about 0.050 gram atoms per liter of fluoride atoms; and the amount of component (D) is in the range from about 0.001 to about 0.01 w/o.

11. A composition according to claim 10, wherein the amount of component (B) is such as to provide no more than about 0.00059 gram atoms of the total of Zr, Ti, Sn, Al, and Fe per liter of composition, and the fluoride ion activity is such as to result in a fluoride ion activity meter reading within the range from about −75 to about −105 mv.

12. A composition according to claim 11, wherein the nature and amount of component (B) are such as to provide from about 0.00038 to about 0.00059 gram atoms of Zr per liter of composition. and the amount of component (C) is such as to provide from about 0.006 to about 0.014 gram atoms per liter of fluoride atoms.

13. A process for cleaning an aluminum container with an acid or alkaline cleaner, rinsing the cleaned surface with water, contacting the cleaned and rinsed surface with a lubricant and surface conditioner composition, and subsequently rinsing with water and drying the surface so contacted, so as to produce a container having a coefficient of static friction of not more than 1.5 on at least its exterior surfaces, wherein the improvement comprises using as the lubricant and surface conditioner composition a composition according to claim 12 at a temperature in the range from about 21° to about 54° C. for a time within the range from about 20 to about 30 seconds.

14. A process for cleaning an aluminum container with an acid or alkaline cleaner, rinsing the cleaned surface with water, contacting the cleaned and rinsed surface with a lubricant and surface conditioner composition, and subsequently rinsing with water and drying the surface so contacted, so as to produce a container having a coefficient of static friction of not more than 1.5 on at least its exterior surfaces, wherein the improvement comprises using as the lubricant and surface conditioner composition a composition according to claim 11 at a temperature in the range from about 21° to about 54° C. for a time within the range from about 20 to about 30 seconds.

15. A process for cleaning an aluminum container with an acid or alkaline cleaner, rinsing the cleaned surface with water, contacting the cleaned and rinsed surface with a lubricant and surface conditioner composition, and subsequently rinsing with water and drying the surface so contacted, so as to produce a container having a coefficient of static friction of not more than 1.5 on at least its exterior surfaces, wherein the improvement comprises using as the lubricant and surface conditioner composition a composition according to claim 10 at a temperature in the range from about 21° to about 54° C. for a time within the range from about 20 to about 30 seconds.

16. A process for cleaning an aluminum container with an acid or alkaline cleaner, rinsing the cleaned surface with water, contacting the cleaned and rinsed surface with a lubricant and surface conditioner composition, and subsequently rinsing with water and drying the surface so contacted, so as to produce a container having a coefficient of static friction of not more than 1.5 on at least its exterior surfaces, wherein the improvement comprises using as the lubricant and surface conditioner composition a composition according to claim 9 at a temperature in the range from about 21° to about 54° C. for a time within the range from about 20 to about 30 seconds.

17. A process for cleaning an aluminum container with an acid or alkaline cleaner, rinsing the cleaned surface with water, contacting the cleaned and rinsed surface with a lubricant and surface conditioner composition, and subsequently rinsing with water and drying the surface so contacted, so as to produce a container having a coefficient of static friction of not more than 1.5 on at least its exterior surfaces, wherein the improvement comprises using as the lubricant and surface conditioner composition a composition according to claim 8 at a temperature in the range from about 21° to about 54° C. for a time within the range from about 20 to about 30 seconds.

18. A process for cleaning an aluminum container with an acid or alkaline cleaner, rinsing the cleaned surface with water. contacting the cleaned and rinsed surface with a lubricant and surface conditioner composition, and subsequently rinsing with water and drying the surface so contacted, so as to produce a container having a coefficient of static friction of not more than 1.5 on at least its exterior surfaces, wherein the improvement comprises using as the lubricant and surface conditioner composition a composition according to claim 7 at a temperature in the range from about 21° to about 54° C. for a time within the range from about 20 to about 30 seconds.

19. A process for cleaning an aluminum container with an acid or alkaline cleaner, rinsing the cleaned surface with water, contacting the cleaned and rinsed surface with a lubricant and surface conditioner composition, and subsequently rinsing with water and drying the surface so contacted, so as to produce a container having a coefficient of static friction of not more than 1.5 on at least its exterior surfaces, wherein the improvement comprises using as the lubricant and surface conditioner composition a composition according to claim 1 at a temperature in the range from about 10° to about 85° C. for a time within the range from about 5 to about 60 seconds.

20. A pair of complementary concentrates for an aqueous lubricant and surface conditioner composition, wherein the first concentrate consists essentially of water and:

(A) a dissolved phosphorus containing surfactant component that is a mixture of molecules conforming to the general formula I:

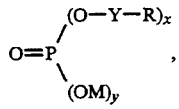

(I)

where M is selected from the group consisting of H and alkali metal cations; x=1 or 2 and y=3−x; Y is an ethylene moiety; and R is an imidazoline moiety conforming to general formula II:

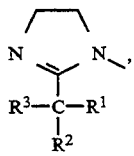

(II)

where each of $R^1$ and $R^2$ is independently selected, except that $R^1$ and $R^2$ may not both be hydrogen, from the group consisting of hydrogen and moieties of the general formula III:

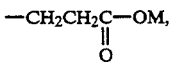

(III)

where M has the same meaning as defined above; and at least 84 mole percent of the $R^3$ moieties in the composition are selected from the group consisting of unsubstituted and unbranched aliphatic moieties having from 10 to 14 carbon atoms, the amount of component (A) being such as to provide from about 0.028 to about 0.053 gram atoms of phosphorus per liter of composition; and (D) from about 0.01 to about 20 w/o of a component selected from molecules conforming to general formula IV:

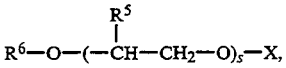

(IV)

wherein $R^6$ is a linear, cyclic, or branched saturated monovalent aliphatic hydrocarbon moiety containing from 4–20 carbon atoms; X is selected from the group consisting of hydrogen, halogen, phenyl, and $R^5$; s is an integer from 1 to 50, preferably from 1 to 20; and $R^5$ is hydrogen; and, optionally, any one or more of the following:

(E) a component selected from molecules conforming to general formula V:

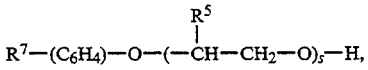

(V)

wherein $R^7$ is a linear, cyclic, or branched saturated monovalent aliphatic hydrocarbon moiety containing 9 carbon atoms; $(C_6H_4)$ is an ortho-, meta-, or para-phenylene nucleus; and $R^5$ and s have the same meaning as for formula IV;

(F) a component selected from chelating agents for the metal containing ions of component (B);

(G) a component selected from molecules conforming to general formula VI:

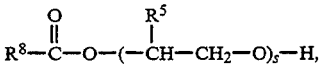

(VI)

wherein $R^8$ is a linear or branched, saturated or unsaturated monovalent aliphatic hydrocarbon moiety containing from 4 to 20 carbon atoms; and $R^5$ and s have the same meaning as in formula IV; and (H) an antimicrobial agent; and the second concentrate consists essentially of:

(B) fluozirconic acid in an amount such as to provide from about 0.057 to about 0.10 gram atoms of Zr per liter of composition; and (C) from about 0.50 to about 1.00 moles per liter of ammonium bifluoride; and, optionally, any one or more of the following:

(E') a component selected from molecules conforming to general formula V:

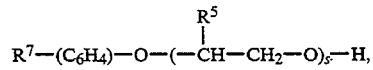

(V)

wherein $R^7$ is a linear, cyclic, or branched saturated monovalent aliphatic hydrocarbon moiety containing 9 carbon atoms; $(C_6H_4)$ is an ortho-, meta-, or para-phenylene nucleus; and $R^5$ and s have the same meaning as for formula IV;

(F') a component selected from chelating agents for the metal containing ions of component (B), preferably selected from the group consisting of molecules, including polymer molecules, each containing at least two moieties selected from group consisting of amino, substituted amino, carboxyl, phosphonate, sulfonate, and carbonyl moieties;

(G') a component selected from molecules conforming to general formula VI:

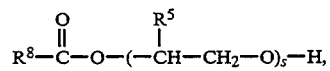

(VI)

wherein $R^8$ is a linear or branched, saturated or unsaturated monovalent aliphatic hydrocarbon moiety containing from 4 to 20 carbon atoms; and $R^5$ and s have the same meaning as in formula IV; and (H') an antimicrobial agent.

* * * * *